US008021125B2

(12) United States Patent
Uratani

(10) Patent No.: US 8,021,125 B2
(45) Date of Patent: Sep. 20, 2011

(54) HERMETIC COMPRESSOR

(75) Inventor: Akio Uratani, Yasu (JP)

(73) Assignee: Panasonic Corporation, Osaka (JP)

( * ) Notice: Subject to any disclaimer, the term of this patent is extended or adjusted under 35 U.S.C. 154(b) by 673 days.

(21) Appl. No.: 11/184,329

(22) Filed: Jul. 19, 2005

(65) Prior Publication Data

US 2006/0018763 A1 Jan. 26, 2006

(30) Foreign Application Priority Data

Jul. 22, 2004 (JP) ..... 2004-214054

(51) Int. Cl.
*F04B 39/04* (2006.01)
*G01F 23/24* (2006.01)

(52) U.S. Cl. ..... 417/228; 417/13; 417/33; 73/304 R

(58) Field of Classification Search ..... 417/13, 417/32, 228; 374/141, 144–146, 183, 185; 73/304 R See application file for complete search history.

(56) References Cited

U.S. PATENT DOCUMENTS 2,928,037 A * 3/1960 Lawrence ..... 307/117
3,766,747 A * 10/1973 Parker ..... 62/226
4,334,215 A * 6/1982 Frazier et al. ..... 340/447
5,249,431 A * 10/1993 Kuribara et al. ..... 62/129
5,420,877 A * 5/1995 Sandstrom ..... 372/34
6,098,457 A * 8/2000 Poole ..... 73/295
6,302,654 B1 * 10/2001 Millet et al. ..... 417/63
2002/0136263 A1 * 9/2002 Wilkins ..... 374/141

FOREIGN PATENT DOCUMENTS

JP 6-159274 6/1994
JP 2001-12351 1/2001

* cited by examiner

*Primary Examiner* — William Rodriguez
*Assistant Examiner* — Philip Stimpert
(74) *Attorney, Agent, or Firm* — RatnerPrestia

(57) ABSTRACT

A hermetic compressor includes a housing accommodating a motor and a compressing mechanism driven by the motor, refrigerating machine oil, which is pooled in the housing, for lubricating the compressing mechanism, refrigerant gas sealed into the housing and to be refrigerant forming a refrigerating cycle, and an oil surface sensor including a thermistor having a given length. A part of the oil surface sensor is impregnated into the refrigerating machine oil, and the sensor senses a temperature immediately after energizing the thermistor and a rate of change in temperature onward, so that a position of an oil surface is detected.

7 Claims, 4 Drawing Sheets

HERMETIC COMPRESSOR

FIELD OF THE INVENTION

The present invention relates to hermetic compressors to be mounted in air-conditioners or refrigerators and used for compressing refrigerant.

BACKGROUND OF THE INVENTION

A conventional hermetic compressor (hereinafter referred to simply as "compressor"), which is formed of a compressing mechanism and an electric motor both accommodated in a housing hermetically welded, is disclosed in Japanese Patent Unexamined Publication No. H06-159274. This compressor is free from refrigerant leakage or water invasion, so that it has been widely used in air-conditioners or refrigerators because of its high reliability.

FIG. 5 shows a sectional view of a conventional compressor. In FIG. 5, compressing mechanism 53 and electric motor 54 are accommodated in cylindrical housing 52 to form a compressor of a high-pressure dome model. Housing 52 is equipped with discharging tube 56 at its upper end for discharging compressed refrigerant gas.

Compressing mechanism 53 is a rolling piston model and rigidly mounted to housing 52, and connected with sucking tube 55 for feeding the refrigerant gas into housing 52. Compressing mechanism 53 is coupled to motor 54 with driving shaft 57, so that it is driven by motor 54.

Motor 54 is disposed above compressing mechanism 53 and connected to hermetic terminal 58 welded at the upper end of housing 52. Terminal 58 is used for powering, and an external source powers motor 54 through this hermetic terminal 58, which is excellent in pressure resistance and airtight performance.

Driving shaft 57 is equipped with a centrifugal pump (not shown) and a lubrication path (not shown), and disposed extending through compressing mechanism 53. The centrifugal pump is disposed at a lower end of driving shaft 57, so that it can pump up refrigerating machine oil pooled at the bottom of housing 52. The lubrication path is formed inside shaft 7 along the axial direction, and supplies the oil pumped up by the centrifugal pump to the respective sliding sections.

The foregoing compressor supplies the refrigerating machine oil pooled in housing 52 to compressing mechanism 53 and its bearings for lubrication. The refrigerating machine oil pooled in housing 52 is discharged together with compressed refrigerant gas from the compressor. Under normal conditions, the oil circulates through a refrigerant circuit and returns to the compressor, so that an amount of the oil is maintained in housing 52. However, the amount of the oil varies depending on the operation, and it sometimes becomes short and fails in lubrication.

To the contrary, if the oil is pooled excessively, a large amount of the refrigerating machine oil is discharged together with compressed refrigerant gas from compressor 51, thereby inviting lower performance of a heat exchanger as well as of the refrigerator.

Several ideas have been proposed to the problem discussed above, e.g. oil surface 59 in housing 52 is sensed by a sensor for detecting a shortage or an excess of the oil pooled, so that the compressor is protected. One of those ideas is disclosed in Japanese Patent Unexamined Publication No. 2001-12351: Detection of a lower oil surface 59 starts a protecting action such as halting the operation of compressor 51 or collecting the refrigerating machine oil from the refrigerant circuit, thereby preventing the compressor from being damaged.

Detecting a position of oil surface 59 in housing 52 needs sensors disposed in housing 52 around the oil surface and signals to be transmitted from the sensors to the outside of housing 52. To achieve the detection, a conventional compressor has employed two thermistors in a detector, and a difference in temperatures of the two thermistors has told the oil surface position. The conventional compressor is also equipped with a hermetic terminal at the upper section of the housing, and the thermistors are connected to the hermetic terminal for transmitting the signals to the outside of the housing. The foregoing structure needs two thermistors and connections between the termistors and the hermetic terminal, so that the structure becomes complex and causes poor operation, and invites lower reliability because of a possible disconnection. Some of conventional compressors employ a single thermistor, which however simply measures a temperature, so that an accurate detection of the oil surface cannot be expected.

The foregoing publication (No. 2001-12351) also discloses that an oil surface sensor, which is integrally formed of a detector for detecting an oil surface in the housing and hermetic terminals, is mounted on a side-wall of the housing. However, since the side-wall is shaped like a cylinder, the mounting of the sensor onto the side-wall will invite a defect in airtight performance due to distortion, or causes a failure in airtight performance due to a collision in assembling the compressor.

Further, the oil surface sensor is mounted in the housing at a place corresponding to the lower limit of the oil surface, and after a detection of the lower limit of the oil surface, the oil surface cannot rebound immediately although an oil-surface rebounding action is taken. This delay further lowers the oil surface. This phenomenon sometimes causes serious damage to the compressor.

On top of that, employment of sensors for detecting simply a temperature of the refrigerant gas and that of the refrigerating machine oil sometimes shows temperatures similar to each other depending on an operating condition, and an operation during a transition period particularly causes the sensors to malfunction.

SUMMARY OF THE INVENTION

A hermetic compressor of the present invention comprises the following elements:

- an electric motor;
- a compressing mechanism driven by the motor;
- a housing accommodating the motor and the compressing mechanism;
- refrigerating machine oil, pooled in the housing, for lubricating the compressing mechanism;
- refrigerant gas, sealed into the housing, to be refrigerant that forms a refrigerating cycle; and
- an oil surface sensor including a thermistor having a given length. The oil surface sensor is placed such that a part thereof extends into the refrigerating machine oil, and the sensor senses a temperature immediately after the power-on and a rate of change in temperature onward, thereby detecting an oil surface of the refrigerating machine oil.

The foregoing structure allows the compressor to be in a simple construction, and to detect positively the oil surface in the housing, so that reliability of refrigerators employing this compressor can be improved.

DETAILED DESCRIPTION OF PREFERRED EMBODIMENTS

Exemplary embodiments of the present invention are demonstrated hereinafter with reference to the accompanying drawings.

Exemplary Embodiment 1

Figure 1:
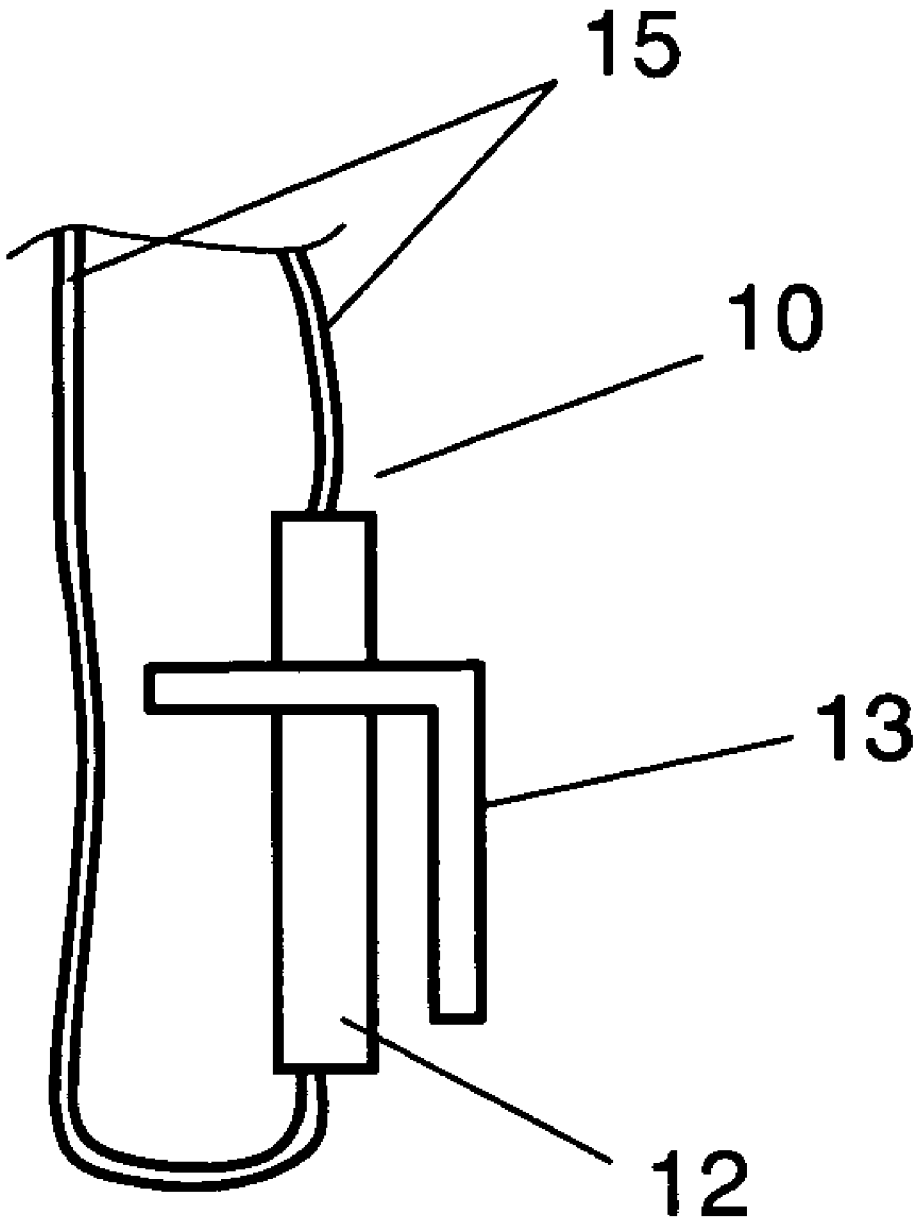
FIG. 1 shows an oil surface sensor to be placed in a compressor in accordance with a first exemplary embodiment of the present invention.
Figure 2:
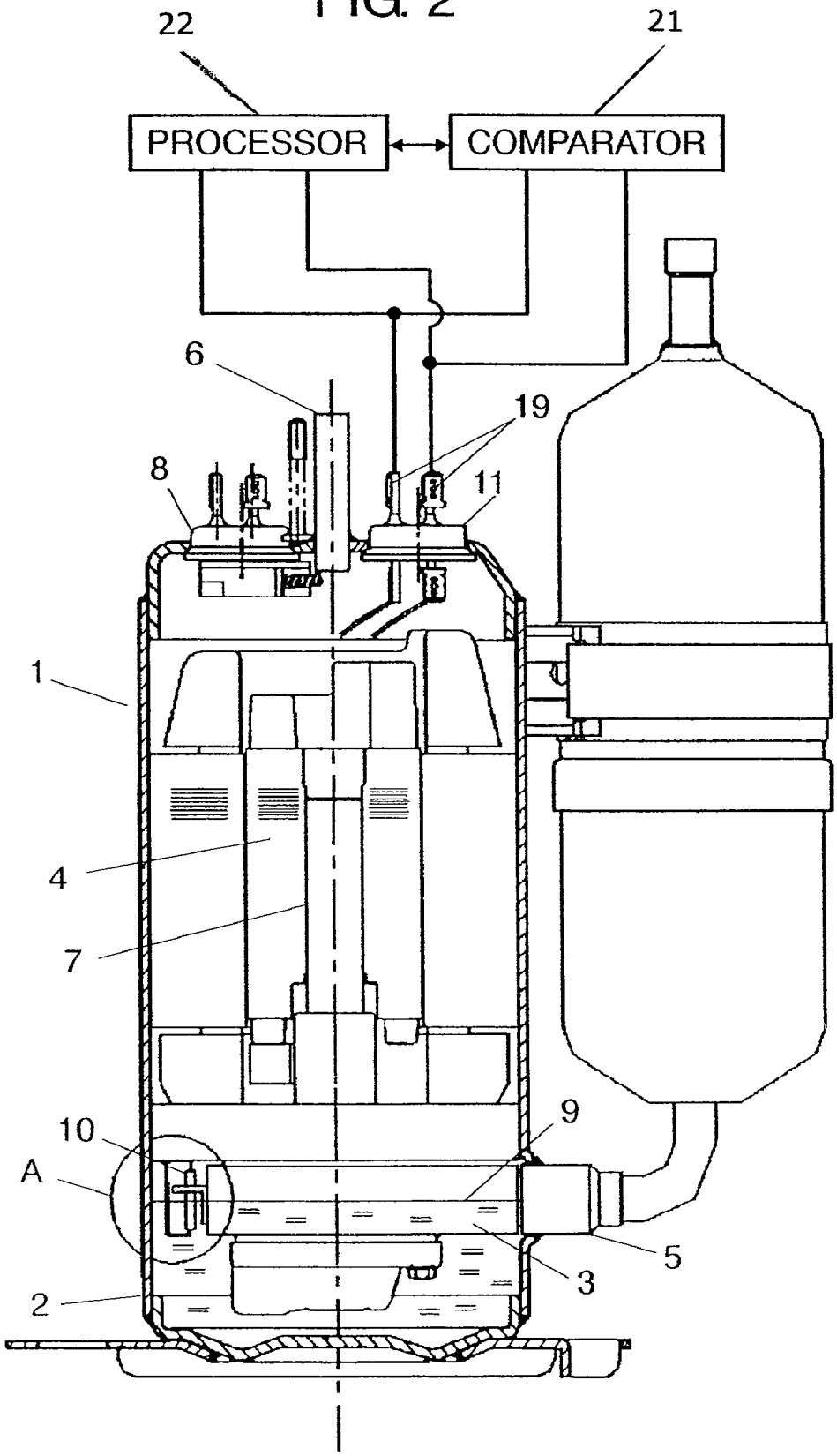
FIG. 2 shows a schematic diagram illustrating a compressor in accordance with the first exemplary embodiment of the present invention.
Figure 3:
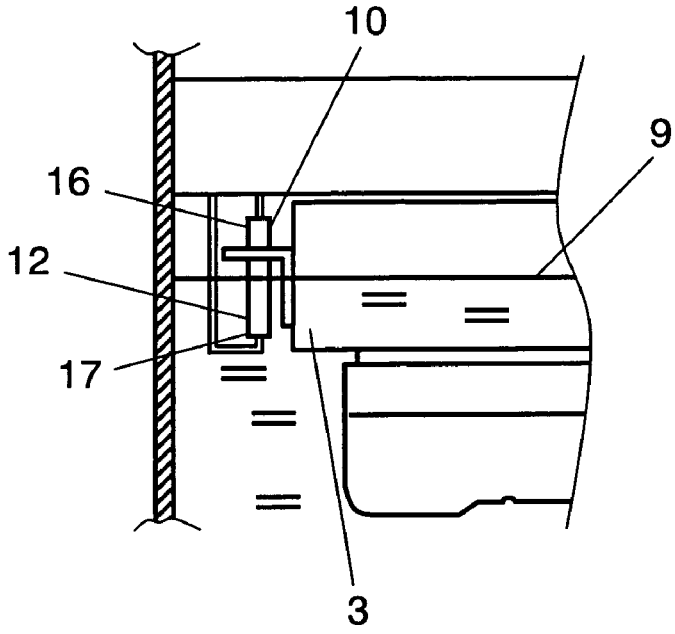
FIG. 3 shows an enlarged view of section A shown in FIG. 2.

FIG. 1 shows oil surface sensor 10 placed in a compressor in accordance with the first exemplary embodiment of the present invention. FIG. 2 shows a schematic diagram illustrating the compressor in accordance with the first exemplary embodiment, and FIG. 3 shows an enlarged view of section A shown in FIG. 2.

In FIG. 2, compressor 1 is formed of compressing mechanism 3 and motor 4 both accommodated in cylindrical housing 2. In other words, compressor 1 shapes like a high pressure dome. Housing 2 is equipped with discharge tube 6 at its upper end for discharging compressed refrigerant gas.

Compressing mechanism 3 is a rolling piston model and rigidly mounted to housing 2, and connected with sucking tube 5 for feeding refrigerant gas into housing 2. Compressing mechanism 3 is coupled to motor 4 with driving shaft 7, so that it is driven by motor 4.

Motor 4 is disposed above compressing mechanism 3 and connected to hermetic terminal 8 welded at the upper end of housing 2. Terminal 8 is used for powering, and an external source powers motor 4 through this hermetic terminal 8.

Driving shaft 7 is equipped with a centrifugal pump (not shown) and a lubrication path (not shown), and disposed extending through compressing mechanism 3. The centrifugal pump is disposed at a lower end of driving shaft 7, so that it can pump up the refrigerating machine oil pooled at the bottom of housing 2. The lubrication path is formed inside shaft 7 along the axial direction, and supplies the oil pumped up by the centrifugal pump to the respective sliding sections.

As shown in FIG. 2, oil surface sensor 10 is mounted to compressing mechanism 3 with bolts at a lower section of housing 2 such that it corresponds to a position of an oil surface in housing 2.

As shown in FIG. 1, oil surface sensor 10 is formed of thermistor 12 working as a detector, and holder 13 for anchoring thermistor 12. The foregoing oil surface sensor 10 is fixed to compressing mechanism 3 with bolts in a direction at right angles to the oil surface in housing 2. Thermistor 12 has a given length (corresponding to a change in oil surface 9, namely, a length falls within variations of the oil surface), and is placed such that its upper end corresponds to the upper limit position of oil surface 9 and its lower end corresponds to a position between the middle and the lower limit position of the oil surface.

Thermistor 12 has two signal leads 15 at its upper and lower ends, and those two signal leads 15 are coupled to hermetic terminal 11 placed at the upper section of housing 2, and another signal lead 19 is coupled to another end of terminal 11. Signal lead 19 is coupled to a controller (not shown) for processing signals detected by thermistor 12.

Thermistor 12 also has an insulator at its middle so that holder 13 extends through this insulator for anchoring thermistor 12 with insulation maintained.

An oil-surface detecting action of compressor 1 is demonstrated hereinafter with reference to FIGS. 2 and 3. Compressor 1 discharges not only the refrigerant but also the refrigerating machine oil, so that oil surface 9 in housing 2 changes during the operation. In order to solve this problem, this first embodiment proposes that oil-surface sensor 10 detect a position of the oil surface in housing 2. In the case of using the high-pressure dome model, while a temperature of the refrigerating machine oil stands at around 60° C. during the operation, that of the refrigerant gas stands at around 80° C. Then a voltage is applied across oil surface sensor 10, and senses the temperature immediately after the energization. This temperature differs due to a difference in temperature between the machine oil and the refrigerant gas, and a rate of impregnated sensor 10 into the machine oil.

The rate of change in temperature during the energization onward differs depending on the rate of impregnated sensor 10 into the machine oil, because the thermistor generates heat by applying a voltage, and a heat amount differs in the atmosphere of the refrigerant gas or in the refrigerating machine oil. Both of an initial temperature and the rate of change in temperature depending on the rate of impregnated sensor 10 into the machine oil are measured in advance, and the data measured are stored in a memory (not shown). Data supplied by sensor 10 in actual operation are compared with the data stored, so that a position of oil surface 9 during the operation can be detected.

FIG. 3 shows a more specific instance; in the case of oil surface 9 existing between upper end 16 and lower end 17 of the thermistor 12, a temperature at the initial stage of energizing thermistor 12 stands between the temperature of the refrigerant gas and that of the refrigerating machine oil. The rate of change in temperature is measured during the energization onward, then the rate of change differs depending on how much sensor 10 extends into the machine oil. This difference is compared (i.e. by a comparator 21) with the data stored, and the comparison tells whether the atmosphere of sensor 10 is fully occupied by the refrigerant gas or fully occupied by the refrigerating machine oil, or how much sensor 10 extends into the oil (i.e. by a processor 22), thereby detecting a position of oil surface 9.

As discussed above, the temperature of refrigerant gas generally differs from that of the refrigerating machine oil; however, if they become an identical temperature, this first embodiment allows detecting the oil surface position. The detection is achieved by utilizing the fact that an amount of heat dissipated from thermistor 12 differs depending on whether thermistor 12 is brought into contact with the refrigerant gas or the refrigerating machine oil. The refrigerant gas dissipates heat less than the refrigerating machine oil, so that the thermistor on the gas side detects a higher temperature. As such, a temperature detected by thermistor 12 differs depending on whether thermistor 12 exists in the gas or the oil. Thus apply a voltage across thermistor 12, and measure a temperature immediately after the energizing, and further energization will raise the temperature. The position of oil surface 9 changes with respect to thermistor 12 anchored in a direction at right angles to oil surface 9, so that the rate of rise onward in temperature differs. Detecting both of the initial temperature and the rate of rise onward in temperature can tell a position of oil surface 9 as of the detection.

Foregoing oil-surface sensor 10 is placed at a location corresponding to a limit of oil surface 9 in housing 2. Thus when thermistor 12 determines that oil surface 9 is below thermistor 12, some measures should be taken for raising oil surface 9. For instance, an oil separator or an oil reservoir tank is placed in a discharging line of a refrigerating cycle, and the valve thereof is controlled for feeding the refrigerating machine oil from the sucking side into the compressor in which oil surface 9 is lowered. If thermistor 12 determines that oil surface 9 is above the upper limit, the valve is controlled for halting the oil-supply to the compressor in which oil surface 9 is raised.

When plural compressors are placed in one refrigerating cycle and they are operated simultaneously or independently, each one of the compressors is equipped with oil surface sensor 10 for detecting an oil surface to be controlled. This is a mechanism similar to the case where a refrigerating cycle has one compressor equipped with one oil-surface sensor 10.

The first embodiment proposes to provide compressing mechanism 1 with oil surface sensor 10. This structure allows a positive detection of a lower oil surface 9 in compressor 1, so that troubles caused by failure of lubrication such as seizing can be prevented. Rising of oil surface 9 can be also positively detected, so that excessive discharge of the refrigerating machine oil can be suppressed and adverse influence to performance can be suppressed. As a result, compressor 1 improves its reliability, which eventually improves the reliability and stability of performance of a refrigerating device employing compressor 1.

This first embodiment employs one thermistor 12, and oil surface sensor 10 anchored by holder 13 is mounted to a side wall of compressing mechanism 3. Therefore, assembled oil surface sensor 10 can be mounted to compressing mechanism 3 before assembling the compressing mechanism, so that a position of oil surface in housing 2 can be detected with a fewer errors in mounting sensor 10. As a result, a compressor simply constructed can be achieved because a conventional one has inquired complex connection between plural sensors and signal-taking terminals. Hermetic terminal 11 is not directly mounted onto the surface of cylindrical housing 2, so that housing 2 is free from a failure in airtight performance or pressure resistance due to distortion by welding, and oil surface sensor 10 can be positively mounted to housing 2. On top of that, less damage due to collision can be expected in the assembly line.

Exemplary Embodiment 2

The compressor in accordance with the second exemplary embodiment of the present invention is constructed similar to that in the first embodiment. Different points from the first one are detailed hereinafter.

Figure 4:
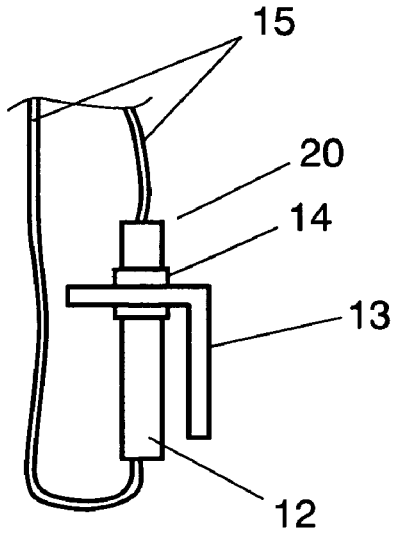
FIG. 4 shows an oil surface sensor placed in a compressor in accordance with a second exemplary embodiment of the present invention.
Figure 5:
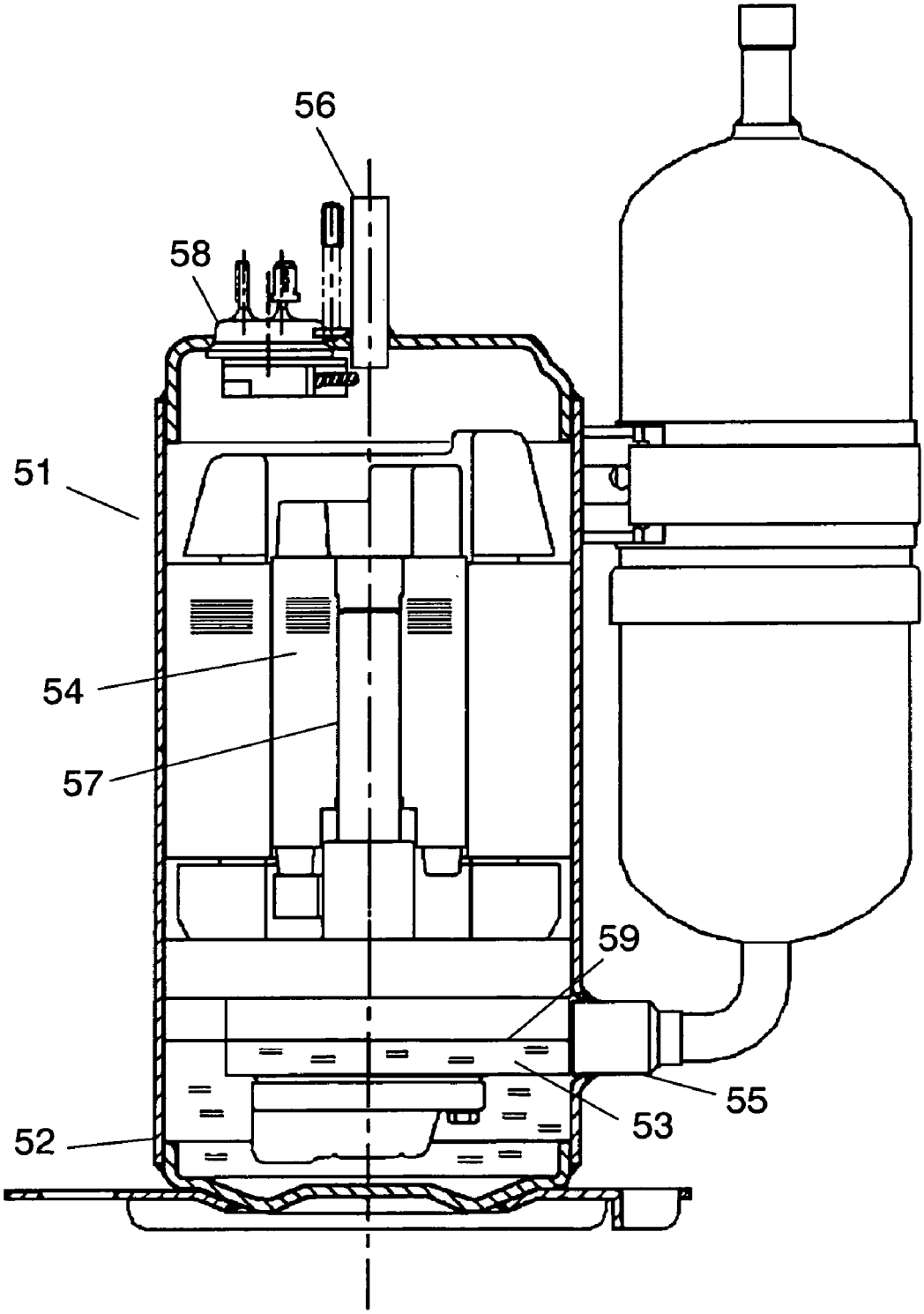
FIG. 5 PRIOR ART
FIG. 5 shows a sectional view illustrating a conventional compressor.

As shown in FIG. 4, oil surface sensor 20 in accordance with the second embodiment senses a temperature with thermistor 12, and also senses a rate of change in temperature onward for detecting a position of oil surface 9. Heat insulator 14 is employed between thermistor 12 and holder 13 that anchors thermistor 12. Holder 13 is fixed to compressing mechanism 3 with bolts, and is preferable to be a metallic holder for stronger fixation. In such a case, a temperature in the compressing mechanism travels through the holder to thermistor 12 and tends to invite an error in sensing the temperature. Thus heat insulator 14 is placed between holder 13 and thermistor 12 to prevent the temperature from traveling to thermistor 12. Heat insulator 14 is made of material having a low heat conductivity, excellent in being mounted as well as withstanding refrigerant, namely, e.g. synthetic resin, so that an original temperature of the oil or that of the refrigerant gas can be correctly detected.

What is claimed is:

1. A hermetic compressor system comprising:

a housing accommodating a motor and a compressing mechanism driven by the motor;

refrigerating machine oil, pooled in the housing, for lubricating the compressing mechanism;

refrigerant gas sealed into the housing and acting as a refrigerant in a refrigerating cycle;

an oil surface sensor including a thermistor having a length;

an insulator;

a holder for holding the oil surface sensor, the holder including a first portion mounted to an external surface of a side wall of the compressing mechanism and a second portion extending outwardly from the external surface of the side wall of the compressing mechanism, the second portion of the holder extending around the insulator;

a comparator which compares a stored temperature of the thermistor and a stored rate of change in temperature of the thermistor after energizing the thermistor to a subsequent temperature of the thermistor and a subsequent rate of change in temperature of the thermistor; and a processor which determines what portion of the length of the thermistor extends into the refrigerating machine oil based on the compared results.

2. The hermetic compressor system of claim 1, wherein the oil surface sensor is formed of a cylindrical single thermistor.

3. The hermetic compressor system of claim 1, wherein the oil surface sensor is coupled to a signal line at an upper end of the oil surface sensor and a lower end of the oil surface sensor, respectively, for taking out a signal.

4. The hermetic compressor system of claim 1, wherein the oil surface sensor is placed in a direction at right angles to the oil surface.

5. The hermetic compressor system of claim 1, wherein the oil surface sensor is placed such that a first section of the oil surface sensor touches the refrigerating machine oil and a second section of the oil surface sensor touches the refrigerant gas.

6. The hermetic compressor system of claim 1, wherein the holder is fixed to the compressing mechanism.

7. The hermetic compressor system of claim 6, wherein the insulator is between the thermistor and the holder.

* * * * *